US011389932B2

(12) United States Patent
Ortiz

(10) Patent No.: US 11,389,932 B2
(45) Date of Patent: Jul. 19, 2022

(54) ADJUSTABLE CROW FOOT WRENCH DEVICES

(71) Applicant: Brett Ortiz, Riverton, WY (US)

(72) Inventor: Brett Ortiz, Riverton, WY (US)

( * ) Notice: Subject to any disclaimer, the term of this patent is extended or adjusted under 35 U.S.C. 154(b) by 0 days.

(21) Appl. No.: 17/249,486

(22) Filed: Mar. 3, 2021

(65) Prior Publication Data

US 2021/0276162 A1 Sep. 9, 2021

Related U.S. Application Data

(60) Provisional application No. 62/984,349, filed on Mar. 3, 2020.

(51) Int. Cl.

| | |
|---|---|
| ***B25B 13/00*** | (2006.01) |
| ***B25B 13/48*** | (2006.01) |
| ***B25B 23/00*** | (2006.01) |
| *B25B 13/50* | (2006.01) |

(52) U.S. Cl.

CPC ..... *B25B 13/481* (2013.01); *B25B 23/0007* (2013.01); *B25B 13/5058* (2013.01)

(58) Field of Classification Search

CPC ..... B25B 27/00; B25B 13/12; B25B 23/00; B25B 23/0007

USPC ..... 81/DIG. 8

See application file for complete search history.

(56) References Cited

U.S. PATENT DOCUMENTS

| | | | | |
|---|---|---|---|---|
| 397,618 | A * | 2/1889 | Vinton | B25B 13/5058 81/101 |
| 986,112 | A | 3/1911 | Wood | |
| 1,456,290 | A | 5/1923 | Tell | |
| 1,512,559 | A * | 10/1924 | Moore | B25B 13/16 81/165 |
| 2,358,362 | A | 9/1944 | Taylor | |
| 2,539,964 | A | 9/1945 | Montgomery | |
| 2,600,617 | A * | 6/1952 | Coates | B25B 13/14 81/165 |
| 2,699,082 | A | 1/1955 | Viets | |
| 2,708,855 | A | 5/1955 | Fish | |
| 2,715,347 | A | 8/1955 | Johnson | |
| 3,326,068 | A | 6/1967 | Lanzetta | |
| 4,277,991 | A | 7/1981 | Stubenrauch | |
| 4,548,104 | A | 10/1985 | Hendricks | |

(Continued)

FOREIGN PATENT DOCUMENTS

| | | | |
|---|---|---|---|
| DE | 431061 | C | 7/1926 |
| GB | 618203 | A | 2/1949 |
| WO | 2010013014 | A2 | 2/2010 |

*Primary Examiner* — Lee D Wilson

(74) *Attorney, Agent, or Firm* — Patterson Thuente IP

(57) ABSTRACT

Disclosed herein are devices, systems, and methods of an adjustable crowfoot wrench for use with large format fasteners such as bolts or hydraulic line nuts over 1 inch in size. The adjustable crowfoot wrench includes a base, a translating arm, and a gear. The translating arm include one or more fastener pads and a threaded translating shaft. The gear is configured to threadably engage the threaded translating shaft of the translating arm. The threaded translating shaft is configured to be received by and translate through a translating channel of the base. The base also includes a stationary pad, a drive aperture and gear retaining arms. The gear is retained by the gear retaining arms of the base when the gear is threadably engaged with the translating arm within the base.

6 Claims, 8 Drawing Sheets

(56) References Cited

U.S. PATENT DOCUMENTS

| | | | | |
|---|---|---|---|---|
| 4,967,625 | A | 11/1990 | Kolari et al. | |
| 6,167,786 | B1 * | 1/2001 | Kilgore | B25B 13/14 81/129 |
| D778,699 | S | 2/2017 | Roy | |
| 10,093,001 | B1 * | 10/2018 | Hock | B25B 13/08 |
| 2004/0025647 | A1 | 2/2004 | Wang | |
| 2014/0373687 | A1 * | 12/2014 | Chkautovich | B25B 13/5058 81/129 |

* cited by examiner

ADJUSTABLE CROW FOOT WRENCH DEVICES

RELATED APPLICATION

The present application claims the benefit of U.S. Provisional Application No. 62/984,349 filed Mar. 3, 2020, which is hereby incorporated herein in its entirety by reference.

TECHNICAL FIELD

Described herein are wrenches, and more particularly, crowfoot wrenches for use with large fasteners.

BACKGROUND

Crescent wrenches are configured to loosen or tighten fasteners having at least two parallel flat facets, such as a hex head bolt, square head bolt, or hex head hydraulic line fitting. Large diameter fasteners, for example, fasteners having diameters above 1 inch, require crescent wrenches that are commensurate in size and, therefore, tend to be large and cumbersome. Conventionally, a user who worked with a variety of large size fasteners would need to carry a vast array of cumbersome and expensive crescent wrenches. Additionally, large fasteners may be located in small spaces such that a full-size crescent wrench is impractical for manipulating that particular fastener.

Crowfoot wrenches were developed to aid the user needing a variety of crescent wrench sizes and to manipulate fasteners in small spaces. Crowfoot wrenches include a manipulating head similar to a crescent wrench of corresponding size, but the crowfoot wrench includes a drive aperture instead of a full handle. The user would manipulate the crowfoot wrench by inserting a drive of a universal handle into the drive aperture of the crowfoot wrench. Thus, a set of crowfoot wrenches having various sizes can be manipulated by the same universal handle. Crowfoot wrenches allowed the user to carry a set of much smaller crowfoot wrenches instead of a set of full crescent wrenches.

Still, large fasteners, such as hydraulic line nuts having a diameter of greater than 1 inch, require an extensive set of crowfoot wrenches to accommodate the various sizes of large fasteners. Though these large sets of crowfoot wrenches may be an improvement over conventional sets of crescent wrenches, they are still cumbersome and costly in their own right.

SUMMARY

Disclosed herein are devices, systems and methods of an adjustable crowfoot wrench for use with large format fasteners, such as bolts or hydraulic line nuts over 1 inch in size. The adjustable crowfoot wrench includes a base, a translating arm, and a gear. The translating arm includes one or more fastener pads and a threaded translating shaft. The gear is configured to threadably engage the threaded translating shaft of the translating arm. The threaded translating shaft is configured to be received by and translate through a translating channel of the base. The base also includes a stationary pad, a drive aperture and gear retaining arms. The gear is retained by the gear retaining arms of the base when the gear is threadably engaged with the translating arm within the base. A fastener is engaged by the adjustable crowfoot wrench by rotating the gear such that the translating arm advances the one or more fastener pads towards the stationary pad and therefore capturing the fastener between the one or more fastener pads and the stationary pad.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
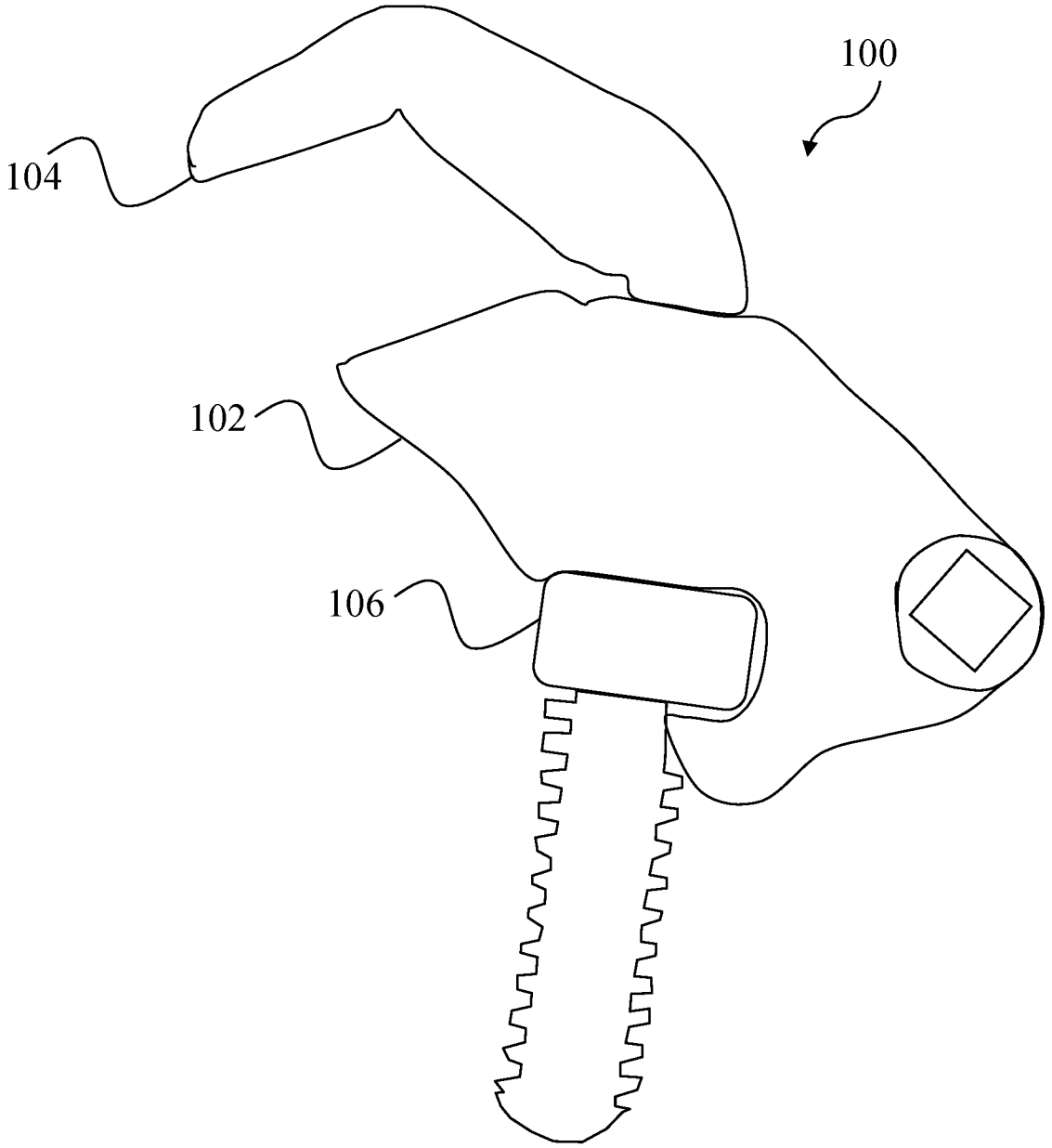
FIG. 1 is a side view of an adjustable crowfoot wrench as described herein.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Disclosed herein are devices, systems and methods of an adjustable crowfoot wrench for use with large format fasteners such as bolts or hydraulic line nuts over 1 inch in size. Referring to FIG. 1, an embodiment of an adjustable crowfoot wrench 100 is depicted. In this embodiment, adjustable crowfoot wrench 100 includes a base 102, a translating arm 104, and a gear 106. In embodiments, base 102, translating arm 104, and gear 106 can be made of various materials such as steel, tool hardened steel, various stainless steels, or any other suitable material.

Figure 2A:
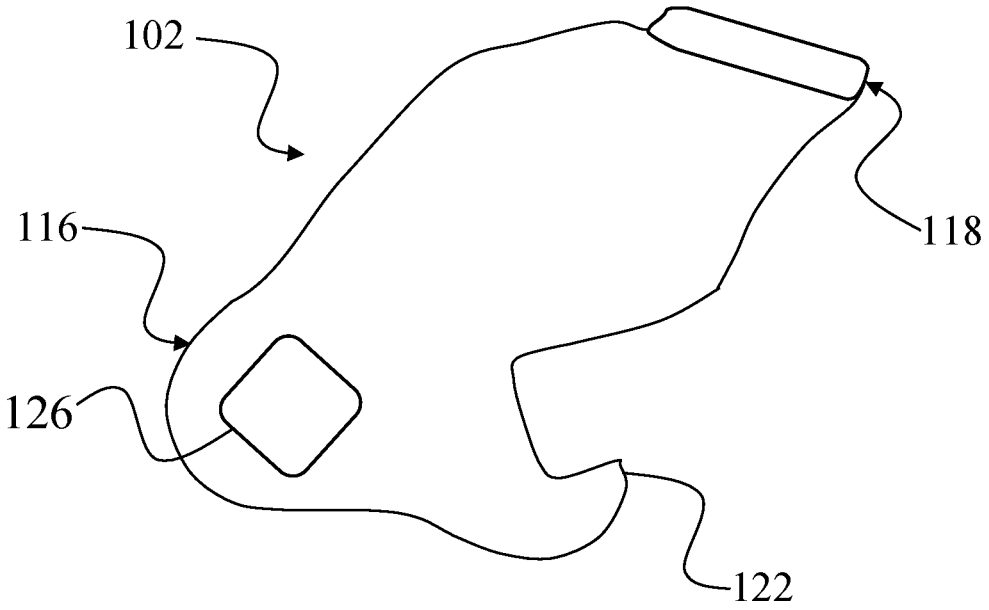
FIG. 2A is a side view of a base of the adjustable crowfoot wrench of FIG. 1.
Figure 2B:
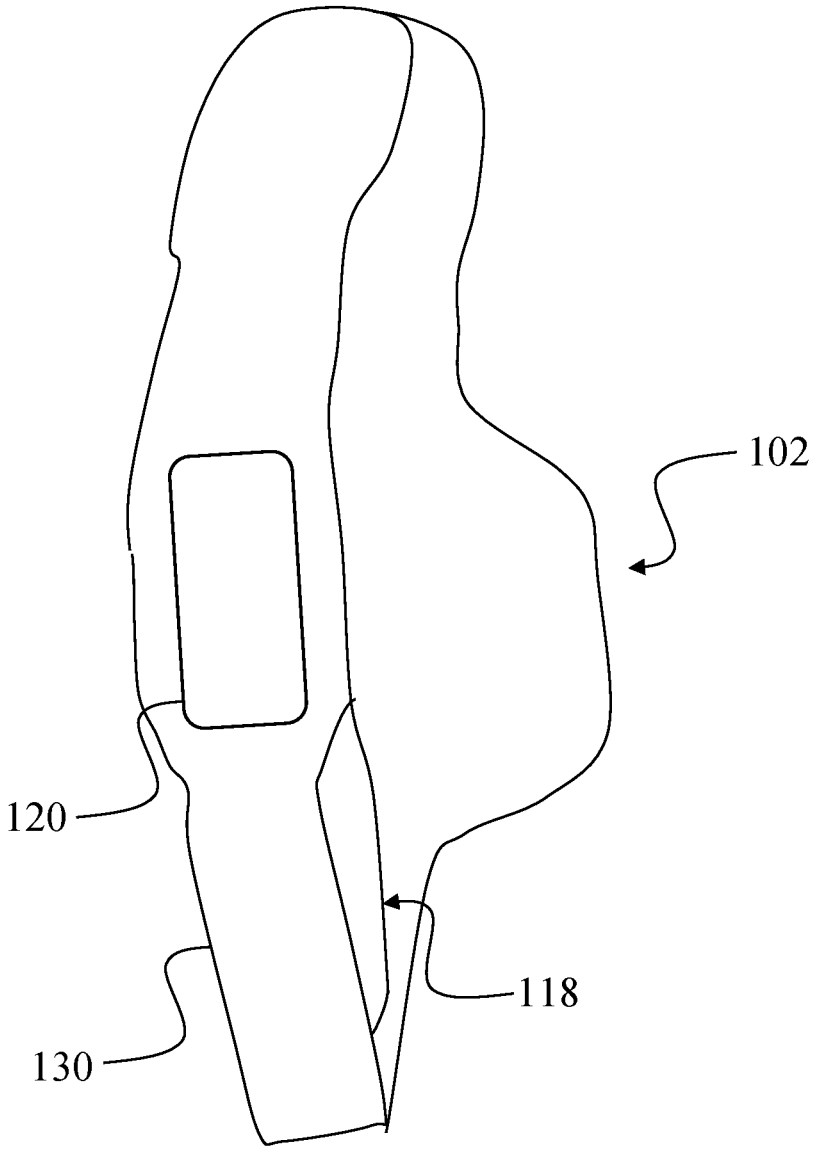
FIG. 2B is a top view of the base of the adjustable crowfoot wrench of FIGS. 1 and 2A.

Referring now to FIGS. 2A and 2B, base 102 includes a drive portion 116, a fastener engaging portion 118, a translating channel 120, and gear retaining arms 122. Drive portion 116 further includes a square drive aperture 126. Square drive aperture 126 is configured to receive a square drive. In embodiments, square drive aperture 126 can be any square drive size ranging from 0.25 inch to 1.5 inch square drive or larger. For example, and as depicted in FIG. 2A, drive portion 116 of base 102 includes a 0.5 inch square drive aperture in compliance with ASME B107.110. In other embodiments, drive portion can include various other drive shapes such as spline, hex, or other suitable drive shape.

Fastener engaging portion 118 further includes stationary pad 130. In this embodiment, stationary pad 130 includes a flat, machined surface configured for engaging a fastener. For example, stationary pad 130 is configured to engage with one side of a multi-faceted bolt head or hydraulic line nut. In another embodiment, stationary pad 130 includes a toothed or ridged surface configured to engage a smooth surface such as a pipe. In this embodiment, the toothed or ridged surface provides a high-friction engagement with a smooth-surfaced object such as a pipe.

In this embodiment, translating channel 120 includes a rectangular aperture beginning adjacent stationary pad 130 and terminating prior to gear retaining arms 122. Translating channel 120 is configured to receive and guide translating arm 104.

In this embodiment, gear retaining arms 122 include a pair of cantilevered arms configured to retain gear 106 when gear 106 is engaged with translating arm 104. Gear retaining arms 122 can comprise other shapes such as a single, centered arm, a cantilevered ring, or any other shape suitable for retaining gear 106.

Figure 3:
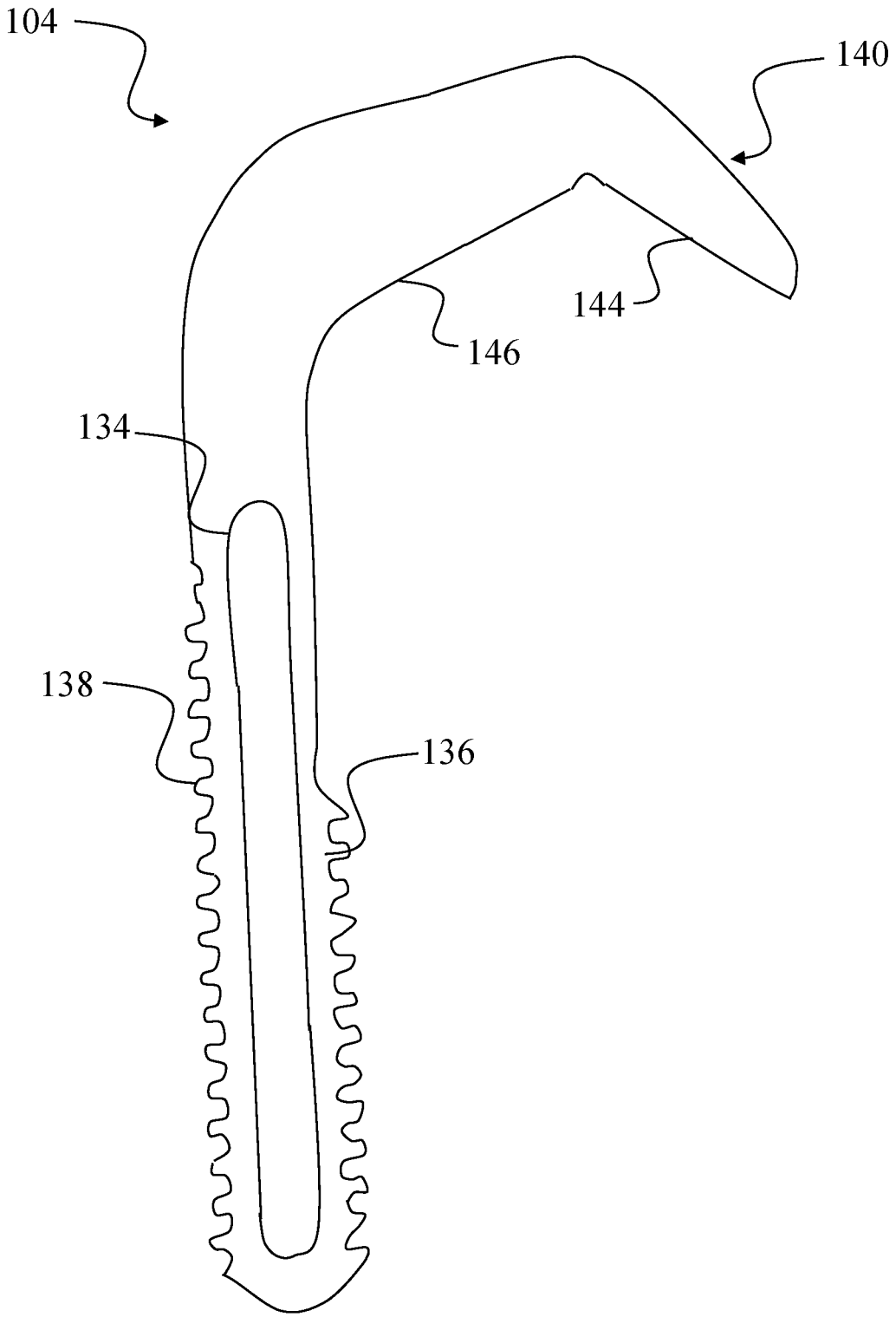
FIG. 3 is a side view of a translating arm of the adjustable crowfoot wrench of FIG. 1.

Referring now to FIG. 3, translating arm 104 includes a translating shaft 134, an inner worm gear 136, and outer worm gear 138, and a translating fastener engaging portion 140. Translating shaft 134 is sized and shaped to be slidably received in translating channel 120 of base 102. In particular, translating shaft 134 is rectangular in shape such that translating shaft 134 translates within translating channel 120 with minimal play. Inner worm gear 136 and outer worm gear 138 are arranged such that they form portions of a single helical gear. In other words, inner worm gear 136 and outer worm gear 138 would form a continuous helical gear should translating shaft 134 be cylindrical rather than rectangular. In embodiments, inner worm gear 136 and outer worm gear 138 include tooth and pitch size and shape suitable for allowing translation while providing cantilevered structural support for translating fastener engaging portion 140. In other embodiments, inner worm gear 136 and outer worm gear 138 can include a tight tooth size and pitch commensurate with precision translation.

In embodiments, translating fastener engaging portion 140 includes a first translating pad 144 and a second translating pad 146. In alternative embodiments, translating fastener engaging portion 140 includes only a single translating pad, or, more than two translating pads. In this embodiment, first translating pad 144 and second translating pad 146 are arranged approximately 120 degrees to each other such that first translating pad 144 and second translating pad 146 are configured to engage adjacent facets of a hex head bolt or hydraulic line nut.

In this embodiment, first translating pad 144 and second translating pad 146 include a flat, machined surface configured for engaging a fastener. For example, first translating pad 144 and second translating pad 146 can be configured to engage with one side of a multi-faceted bolt head or hydraulic line nut. In another embodiment, first translating pad 144 and second translating pad 146 can include toothed or ridged surfaces configured to engage a smooth surface such as a pipe. In this embodiment, the toothed or ridged surfaces provide a high-friction engagement with a smooth-surfaced object such as a pipe.

In this embodiment, first translating pad 144 is arranged on translating arm 104 such that it is approximately parallel to stationary pad 130 when translating shaft 134 of translating arm 104 is received in translating channel 120 of base 102. Thus, first translating pad 144 and stationary pad 130 are configured to engage the top facet and bottom facet of a hex, square, or other even-sided bolt head or hydraulic line nut.

Figure 4A:
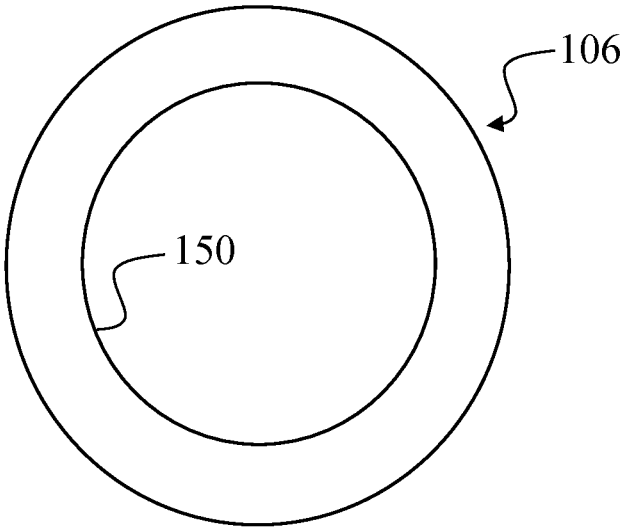
FIG. 4A is a top view of a gear of the adjustable crowfoot wrench of FIG. 1.
Figure 4B:
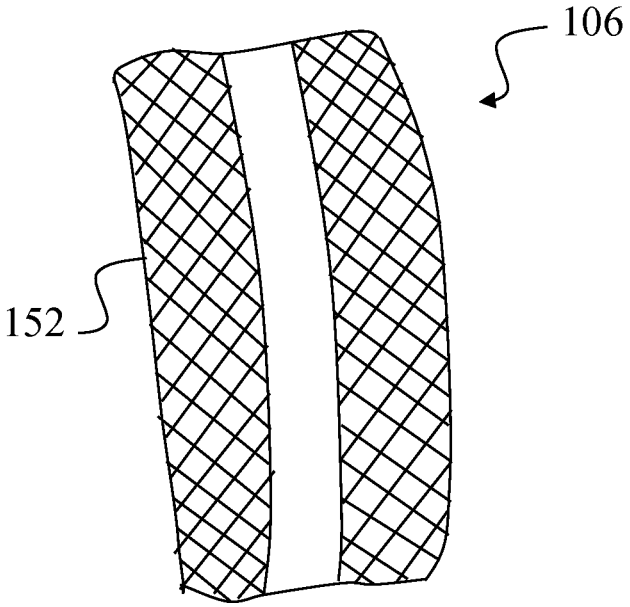
FIG. 4B is a side view of the gear of the adjustable crowfoot wrench of FIGS. 1 and 4A.

Referring to FIGS. 4A and 4B, gear 106 includes a threaded aperture 150 and a knurled surface 152. Threaded aperture 150 includes thread and pitch dimensions corresponding to the tooth and pitch of inner worm gear 136 and outer worm gear 138. In this way, gear 106 is configured to rotatably engage with translating shaft 134 of translating arm 104. Knurled surface 152 of gear 106 is configured to provide a high friction surface for manipulation by a user.

Referring again to FIG. 1, adjustable crowfoot wrench 100 can be assembled by positioning gear 106 within gear retaining arms 122 such that threaded aperture 150 aligns with translating channel 120. Translating shaft 134 of translating arm 102 is inserted and received by translating channel 120 until inner worm gear 136 and outer worm gear 138 engage with threaded aperture 150 of gear 106. Gear 106 is then rotated, via the user manipulating knurled surface 152, such that translating shaft 134 is advanced through threaded aperture 150. When translating shaft 134 is fully advanced through threaded aperture 150, gear 106 is captured within gear retaining arms 122 via translating shaft 134.

Figure 5:
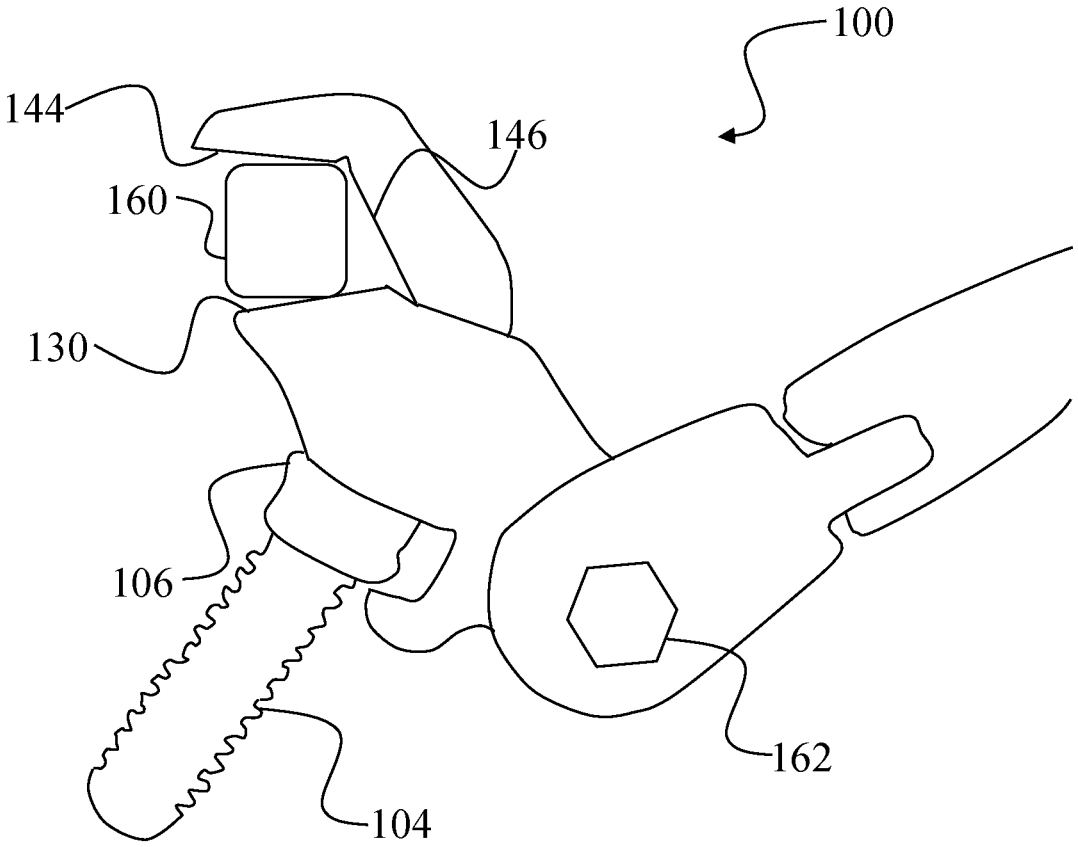
FIG. 5 is a perspective view of the adjustable crowfoot wrench of FIG. 1 in use.
Figure 6A:
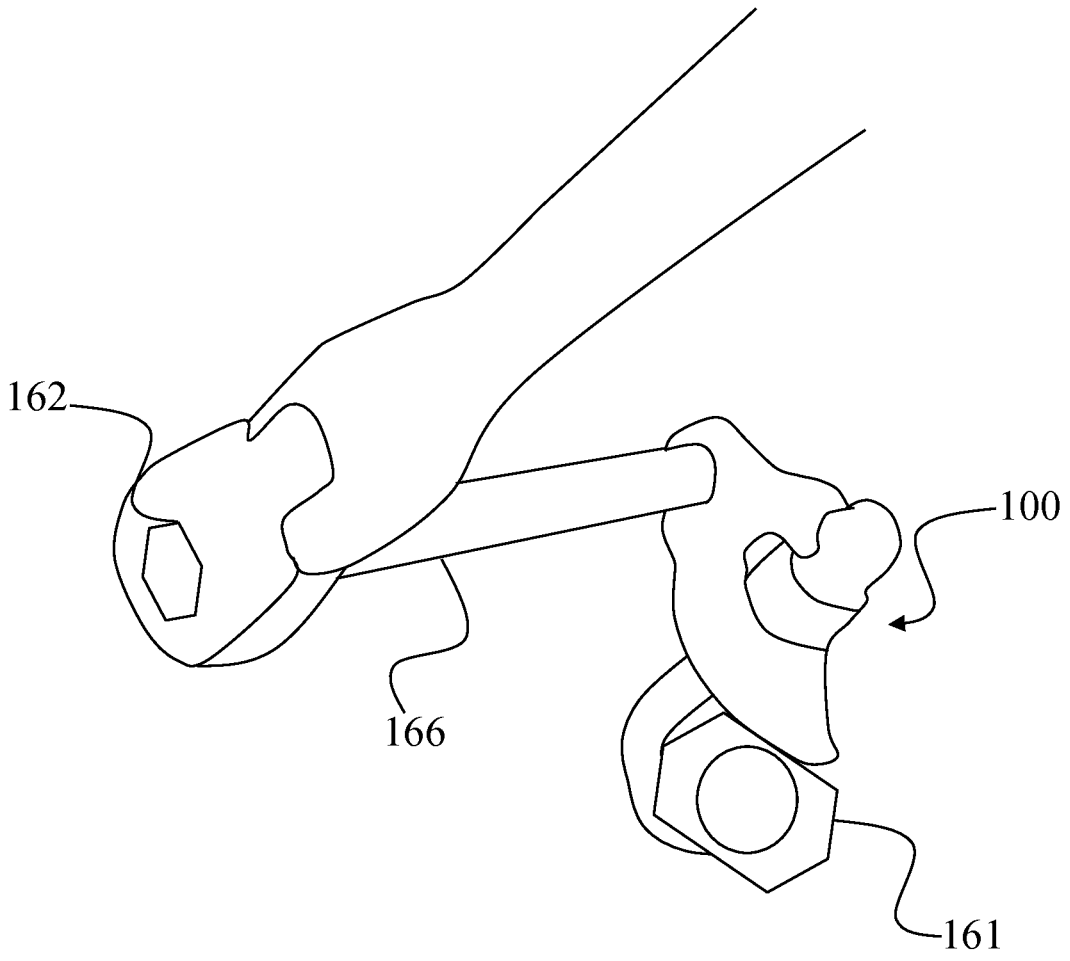
FIG. 6A is a perspective view of the adjustable crowfoot wrench of FIG. 1 in use.
Figure 6B:
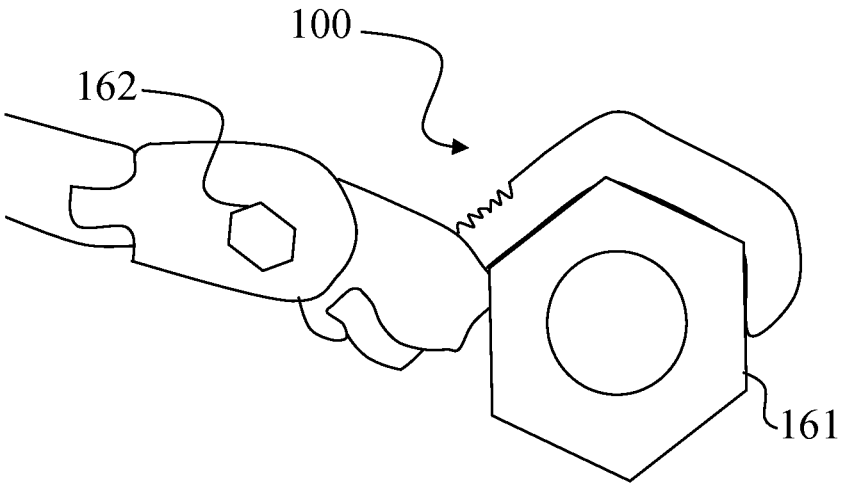
FIG. 6B is a perspective view of the adjustable crowfoot wrench of FIG. 1 in use.

In use, and as depicted in FIGS. 5-7, adjustable crowfoot wrench 100 is adjusted to couple to a first fastener 160, second fastener 161, or other suitable fastener. As an example of the various fasteners that can be manipulated by adjustable crowfoot wrench 100, FIG. 5 depicts adjustable crowfoot wrench 100 coupled to and manipulating first fastener 160 having a square profile. Another example is depicted in FIGS. 6A and 6B where adjustable crowfoot wrench 100 is coupled to and manipulating second fastener 161 wherein second fastener 161 is a hex head hydraulic line nut having a hex profile.

The user rotates gear 106 via knurled surface 152 to move translating arm 104 to accommodate a particular bolt head or line nut. Translating arm 104 is advanced, via user rotating gear 106, such that first translating pad 144 and second translating pad 146 move towards stationary pad 130 of base 102 until first fastener 160 or second fastener 161 is captured by first translating pad 144, second translating pad 146, and stationary pad 130. The user may tighten gear 106 such that first fastener 160 or second fastener 161 is tightly held within first translating pad 144, second translating pad 146, and stationary pad 130, or the user may prefer a looser fit of adjustable crowfoot 100 on first fastener 160 or second fastener 161.

The user can manipulate first fastener 160 or second fastener 161 in order to loosen or tighten first fastener 160 or second fastener 161 by coupling a square drive of a wrench 162 to square drive aperture 126 of base 102. In this embodiment, wrench 162 is a ratcheted driving wrench. In other embodiments, wrench 162 can be a torque wrench, a breaker bar, a pneumatic wrench, or any other wrench having a suitable drive. In some embodiments and referring in particular to FIG. 6A, the user can couple an extension drive 166 in order to manipulate adjustable crowfoot wrench 100 located in tight or otherwise difficult to reach locations.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each of the other dependent claim or a combination of one or more features with other dependent or independent claims. Such combinations are proposed herein unless it is stated that a specific combination is not intended.

For purposes of interpreting the claims, it is expressly intended that the provisions of 35 U.S.C. § 112(f) are not to be invoked unless the specific terms "means for" or "step for" are recited in a claim.

The invention claimed is:

1. An adjustable crowfoot wrench comprising:

a base including a drive portion, a base fastener engaging portion including a stationary pad, a translating channel, and one or more gear retaining arms, the gear retaining arms arranged at an end of the translating channel;

a translating arm including a translating shaft, a translating fastener engaging portion, and one or more worm gears arranged on the translating shaft, the translating shaft being configured to be received by the translating channel of the base and the translating fastener engaging portion extending parallel to and longer than the stationary pad of the base fastener engaging portion and including two or more pads, the two or more pads being disposed at approximately a 120-degree angle to each other; and a gear including a threaded aperture, the gear configured to rotatably couple to the one or more worm gears of the translating shaft, wherein the gear is retained on the translating shaft via the one or more gear retaining arms of the base and the translating fastener engaging portion of the translating arm configured to oppose the fastener engaging portion of the base such that a fastener can be retained between the translating fastener engaging portion and the fastener engaging portion of the base.

2. An adjustable crowfoot wrench of claim 1, wherein the base includes two or more gear retaining arms.

3. An adjustable crowfoot wrench of claim 1, wherein the translating fastener engaging portion and the fastener engaging portion include one or more flat pads.

4. An adjustable crowfoot wrench of claim 1, wherein the translating fastener engaging portion and the fastener engaging portion include one or more ridged pads.

5. An adjustable crowfoot wrench of claim 1, wherein the gear includes a knurled surface arranged on an exterior surface of the gear.

6. An adjustable crowfoot wrench of claim 1, wherein the drive portion is a square drive.

* * * * *